US009422949B2

(12) United States Patent
He et al.

(10) Patent No.: US 9,422,949 B2
(45) Date of Patent: Aug. 23, 2016

(54) ENERGY-RECOVERY GENERATION SYSTEM FOR HANDLING AND CARRYING ELECTRIC VEHICLE

(75) Inventors: Qinghua He, Hunan (CN); Zhongyong Tang, Hunan (CN); Daqing Zhang, Hunan (CN); Zheng Chen, Hunan (CN); Jun Gong, Hunan (CN)

(73) Assignee: SUNWARD INTELLIGENT EQUIPMENT CO., LTD., Hunan (CN)

( * ) Notice: Subject to any disclaimer, the term of this patent is extended or adjusted under 35 U.S.C. 154(b) by 578 days.

(21) Appl. No.: 13/977,100

(22) PCT Filed: Nov. 30, 2011

(86) PCT No.: PCT/CN2011/083265

§ 371 (c)(1),
(2), (4) Date: Jun. 28, 2013

(87) PCT Pub. No.: WO2012/088991

PCT Pub. Date: Jul. 5, 2012

(65) Prior Publication Data

US 2013/0283776 A1 Oct. 31, 2013

(30) Foreign Application Priority Data

Dec. 28, 2010 (CN) ..... 2010 1 0607792

(51) Int. Cl.
*F15B 15/00* (2006.01)
*B66F 9/22* (2006.01)
*F15B 21/14* (2006.01)

(52) U.S. Cl.
CPC ..... *F15B 15/00* (2013.01); *B66F 9/22* (2013.01); *F15B 21/14* (2013.01);
(Continued)

(58) Field of Classification Search
CPC .. F15B 21/14; F15B 2211/63; F15B 11/024; F15B 2011/0243; F15B 11/046; F15B 2013/004; F15B 2211/0515; F15B 13/0846; F15B 13/0853; F15B 13/085; F15B 13/086
See application file for complete search history.

(56) References Cited

U.S. PATENT DOCUMENTS 2,931,182 A * 4/1960 Anderson ..... B23D 15/14 100/46
4,396,087 A * 8/1983 Rock ..... B60K 23/08 172/2

(Continued)

FOREIGN PATENT DOCUMENTS

CN 1830750 A 9/2006
CN 101220823 A 7/2008

(Continued)

OTHER PUBLICATIONS

Hydraulics & Pneumatics ("Slip-in Cartridge Valves", Book 2, Ch. 4. Jan 16, 2008. <e-publication, retrieved on Jan. 11, 2016> <URL:http://hydraulicspneumatics.com/other-technologies/book-2-chapter-4-slip-cartridge-valves-part-1>).*

(Continued)

*Primary Examiner* — F. Daniel Lopez
*Assistant Examiner* — Richard Drake
(74) *Attorney, Agent, or Firm* — Kinney & Lange, P.A.

(57) ABSTRACT

An energy-recovery generation system for a handling and carrying electric vehicle, comprising a hoisting cylinder (9), wherein an output pipeline of the hoisting cylinder (9) is provided with a pressure sensor unit (1) and a directional valve (2); the directional valve (2) is under the control of the pressure sensor unit (1); a first outlet of the directional valve (2) is connected to a tank (5) through a way of a multi-way valve (4) with an operating handle; the pressure oil, flowing out from a second outlet of the directional valve (2), passes through a pump (7) having an oil suction port capable of bearing pressure or a motor, and then passes through the multi-way valve (4), to finally flow back to the tank (5); the pump (7) having an oil suction port capable of bearing pressure or the motor drives an electric motor (16) to output electric energy; an electric energy output end of the electric motor (16) is connected to an energy storage device (20) through a converter (21).

14 Claims, 5 Drawing Sheets

(52) U.S. Cl.
CPC ..... *F15B 2211/20569* (2013.01); *F15B 2211/3116* (2013.01); *F15B 2211/615* (2013.01); *F15B 2211/6313* (2013.01); *F15B 2211/88* (2013.01)

(56) References Cited

U.S. PATENT DOCUMENTS

| | | | | | |
|---|---|---|---|---|---|
| 4,418,778 | A * | 12/1983 | Sato | B62D 5/065 | 180/443 |
| 4,614,148 | A * | 9/1986 | Bates | E21B 33/06 | 251/1.1 |
| 4,723,107 | A | 2/1988 | Schmid | | |
| 4,930,975 | A * | 6/1990 | Ito | B66F 9/22 | 414/635 |
| 6,078,855 | A * | 6/2000 | Kinugawa | E02F 9/22 | 60/431 |
| 6,877,417 | B2 * | 4/2005 | Shimada | E02F 9/2217 | 91/433 |
| 6,922,989 | B2 * | 8/2005 | Nagura | F15B 1/024 | 60/414 |
| 7,043,906 | B2 * | 5/2006 | Suzuki | E02F 9/2217 | 60/422 |
| 7,770,696 | B2 * | 8/2010 | Futahashi | B66F 9/22 | 187/224 |
| 2008/0128214 | A1 | 6/2008 | Tahashi et al. | | |

FOREIGN PATENT DOCUMENTS

| | | | |
|---|---|---|---|
| CN | 102108948 | A | 6/2011 |
| CN | 201953584 | U | 8/2011 |
| EP | 1188709 | A2 | 3/2002 |
| EP | 1308415 | A2 | 5/2003 |
| EP | 2058270 | A1 | 5/2009 |
| JP | H03003897 | A1 | 9/1991 |
| JP | 2008007258 | A | 1/2008 |
| JP | 2008087914 | A | 4/2008 |

OTHER PUBLICATIONS

International Search Report and Written Opinion of the SIPO dated Feb. 21, 2012.
Extended European Search Report dated Aug. 20, 2014, for corresponding European Application No. 11853792.7.

* cited by examiner

ENERGY-RECOVERY GENERATION SYSTEM FOR HANDLING AND CARRYING ELECTRIC VEHICLE

CROSS REFERENCE OF RELATED APPLICATIONS

This application claims priority of the Chinese invention patent application No. 201010607792.0, filed with State Intellectual Property Office of China on Dec. 28. 2010.

TECHNICAL FIELD OF THE INVENTION

The disclosure relates to an energy-recovery generation system for a handling and carrying electric vehicle, and in particular to an energy-recovery generation system for an electric forkhoist truck.

BACKGROUND OF THE INVENTION

The working device part of an electric forkhoist truck generally includes a battery, a controller, a frequency conversion driving module, an electric motor of a frequency control asynchronous alternating-current pump, a hydraulic pump, a control valve and a hydraulic actuating part. Now, taking the hoisting and lowering of the cargo as an example, the working process thereof will be described below: 1, when implementing the hoisting operation of the cargo, the main process thereof includes: operating a hoisting piece handle (3) of a multi-way valve (4)→signaling by a hoisting electric of the multi-way valve (4)→sensing, by a controller of a converter (21), an incoming signal of an intelligent display (19), and starting an electric motor (16) via a frequency conversion driving module→driving a hydraulic pump (7) to output pressure oil through the electric motor (16)→inputting the pressure oil into a P1 port and an A1 port of the hoisting piece of the multi-way valve (4) via an EF pipeline of a steering priority valve (8)→a governor valve (17)→a hoisting cylinder (9)→hoisting the cargo; 2, when unloading the cargo from the height, the main process thereof includes: operating the hoisting piece handle (3) of the multi-way valve (4)→communicating the T1 port with the A1 port of the hoisting piece of the multi-way valve (4)→the pressure oil in the hoisting cylinder passing through the governor valve (17), the A1 port and T1 port of the multi-way valve, and a filter (10), and then flowing into a tank (5)→the cargo lowering from the height with a certain speed, at the moment, the pump electric motor will not be started if no other action operations are carried out synchronously. From the above operations, it can be seen that, when the cargo with certain height and weight is unloaded from the height, the potential energy of the cargo is totally dissipated by converting to be heat.

SUMMARY OF THE INVENTION

The technical problem to be solved by the disclosure is to provide an energy-recovery generation system for a handling and carrying electric vehicle; the energy-recovery generation system for a handling and carrying electric vehicle is configured to reduce system heating and saving energy.

The technical solution of the disclosure is as follows:

An energy-recovery generation system for a handling and carrying electric vehicle, includes a hoisting cylinder; wherein an output pipeline of the hoisting cylinder is provided with a pressure sensor unit and a directional valve; the directional valve is under the control of the pressure sensor unit; a first outlet of the directional valve is connected to a tank through a way of a multi-way valve with an operating handle; the pressure oil, flowing out from a second outlet of the directional valve, passes through a pump having an oil suction port capable of bearing pressure or a motor, and then passes through the multi-way valve, to finally flow back to the tank; the pump having an oil suction port capable of bearing pressure or the motor drives an electric motor to output electric energy; an electric energy output end of the electric motor is connected to an energy storage device through a converter.

Further, the energy storage device is a battery, a capacitor or a lithium battery.

Further, the multi-way valve with the operating handle is a mechanically-operated multi-way valve, an electrically-controlled multi-way valve or a hydraulically-controlled multi-way valve.

Further, the pressure sensor unit is a pressure switch or a pressure sensor.

Further, The energy-recovery generation system includes a lifting piece handle button, a cargo lowering detection enabling signaling switch, a speed control signal potentiometer and a relay, wherein the pressure sensor unit includes a pressure switch and a hoisting cylinder full-extension detection switch; the relay includes a first normal open switch and a second normal open switch; the hoisting piece handle button, the cargo lowering detection enabling signaling switch, the pressure switch and a coil of the relay are connected in series to form a first control branch; the second normal open switch of the relay and a coil of an electromagnet for controlling the directional valve are connected in series to form a second control branch.

Further, a pipeline between an inlet of the pump having an oil suction port capable of bearing pressure or the motor and the tank is provided with a check valve.

Further, the directional valve includes a first reversing unit body and a second reversing unit body; an oil supply path is formed among an oil outlet of the pump having an oil suction port capable of bearing pressure or the motor, the multi-way valve, the directional valve and a working chamber of the hoisting cylinder; a first oil discharge path is formed among the working chamber of the hoisting cylinder, the first reversing unit body of the directional valve, the multi-way valve and the tank; a second oil discharge path is formed among the working chamber of the hoisting cylinder, the first reversing unit body and the second reversing unit body of the directional valve, and the oil inlet of the pump having an oil suction port capable of bearing pressure or the motor; and the first oil discharge path and the second oil discharge path are selectively communicated by the directional valve when the hoisting cylinder drains oil.

Further, the first reversing unit body includes a first cartridge valve, an electromagnetic directional valve, and a first damping orifice connected to the first cartridge valve and the electromagnetic directional valve; the second reversing unit body includes a second cartridge valve, an electromagnetic directional valve, and a second damping orifice connected to the second cartridge valve and to a second control oil port; a II port and a IV port of the first cartridge valve are normally communicated; a I port of the first cartridge valve is always communicated with the II port and the IV port, and the connection or disconnection from the II port and the IV port to the I port is under the control of the electromagnetic directional valve; a i port and a iv port of the second cartridge valve are normally communicated, the i port is always communicated with the ii port and the iv port, and the connection or disconnection from the ii port and the iv port to the i port is under the control of the electromagnetic directional valve. The electromagnetic directional valve includes a first port, a second port, a third port and a fourth port. When the electromagnetic directional valve is not powered on, the first port is communicated with the third port, the second port is communicated with the fourth port, and now, the IV port of the first cartridge valve could be connected to the I port thereof, the iv port of the second cartridge valve could not be communicated with the i port thereof. When the electromagnetic directional valve is powered on, the first port is communicated with the fourth port, the second port is communicated with the third port, and now the IV port of the first cartridge valve could not be communicated with the I port thereof, the iv port of the second cartridge valve could be communicated with the i port thereof, and the power on or off of the electromagnetic directional valve respectively controls a control port of the first cartridge valve or that of the second cartridge valve to be in a communicated state.

Further, the energy-recovery generation system includes a first control mode constituted by a pressure switch latching valve, wherein a first branch are constituted by connecting the hoisting piece handle button, the enabling signaling switch and the hoisting cylinder full-extension detection switch in series; a first sub-branch constituted by connecting the pressure switch and the relay in series and a second sub-branch constituted by a coil of an electromagnet of the pressure switch latching valve are connected in parallel at one end of the first branch, where the hoisting cylinder full-extension detection switch is located, to form the first control branch; the first normal open switch and a coil of an electromagnet of the electromagnetic directional valve of the directional valve are connected in series to form the second control branch; the second normal open switch provides a lowering enabling signal; the speed control signal potentiometer provides a lowering speed control signal; the lowering enabling signal and the speed control signal are accessed to an intelligent display or a controller of the converter.

Further, the energy-recovery generation system includes a second control mode constituted by a time relay and an intermediate relay, wherein the time relay includes a first normal close switch, the intermediate relay includes a third normal open switch and a second normal close switch; the hoisting piece handle button, the enabling signaling switch and the hoisting cylinder full-extension detection switch are connected in series to form a first branch; a I sub-branch constituted by connecting the pressure switch, the first normal close switch and a coil of the intermediate relay in series, a II sub-branch constituted by connecting the third normal open switch and the coil of the relay, and a III sub-branch constituted by connecting the second normal close switch and a coil of the time relay in series are connected in parallel at one end of the first branch, where the hoisting cylinder full-extension detection switch is located, to form a third control branch; the first normal open switch and a coil of an electromagnet of the electromagnetic directional valve of the directional valve are connected in series to form the second control branch; the second normal open switch provides a lowering enabling signal; the speed control signal potentiometer provides a lowering speed control signal; the lowering enabling signal and the speed control signal are accessed to an intelligent display or a controller of the converter.

Further, the energy-recovery generation system includes a third control mode constituted by an intermediate relay, a resistor and a transistor, wherein the intermediate relay includes a first normal close switch and a second normal close switch, the hoisting piece handle button, the enabling signaling switch and the hoisting cylinder full-extension detection switch are connected in series to form a first branch; a i sub-branch constituted by connecting the normal close switch and the coil of the relay in series, a ii sub-branch constituted by connecting the resistor, the pressure switch and the second normal close switch in series, and a iii sub-branch constituted by connecting a coil of an intermediate relay, a collector and an emitter of the transistor in series are connected in parallel at one end of the first branch where the hoisting cylinder full-extension detection switch is located; a base of the transistor is connected between the resistor of the ii sub-branch and the pressure switch, to form a fourth control branch; the first normal open switch and a coil of an electromagnet of the electromagnetic directional valve of the directional valve are connected in series to form the second control branch; the second normal open switch provides a lowering enabling signal; the speed control signal potentiometer provides a lowering speed control signal; the lowering enabling signal and the speed control signal are accessed to an intelligent display or a controller of the converter.

The disclosure has the following advantages:

The disclosure is an energy-recovery generation system for an electric forkhoist truck, which, via the directional valve and the motor or the pump having an oil suction port capable of bearing pressure, uses the pressure oil to drive the oil pump motor to drive the electric motor to generate power, and converts the potential energy of the cargo to be the electric energy stored in the electricity storage device. The device has simple principle, reliable performances and high cost performance, and is convenient to be controlled. By using the generation system, the service time of the battery could be prolonged after single charging, while the system heating could be reduced, and the energy could be saved.

EXPLANATION OF REFERENCE SIGNS

Figure 1:
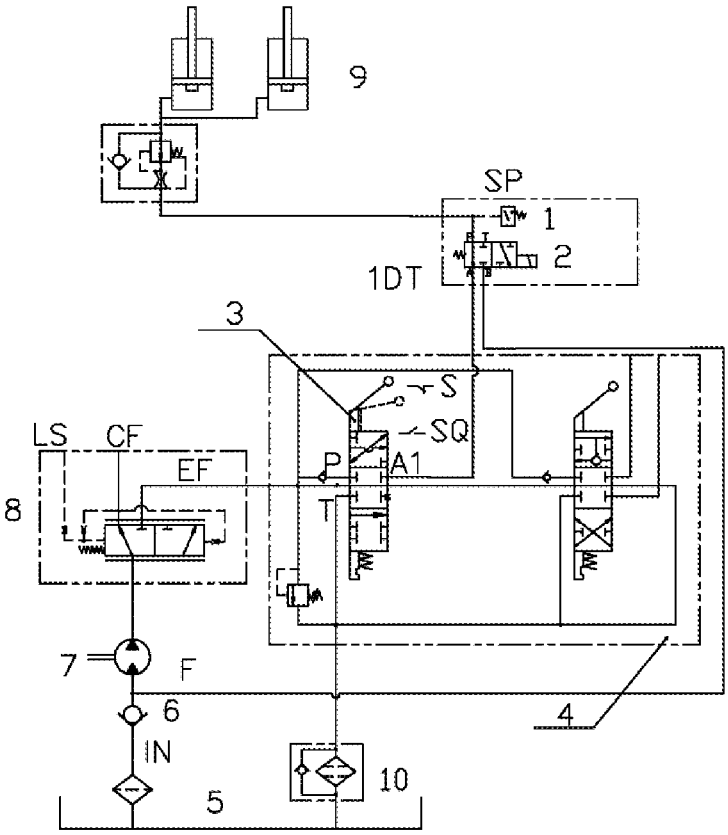
FIG. 1 shows a structure view of an embodiment.
Figure 2:
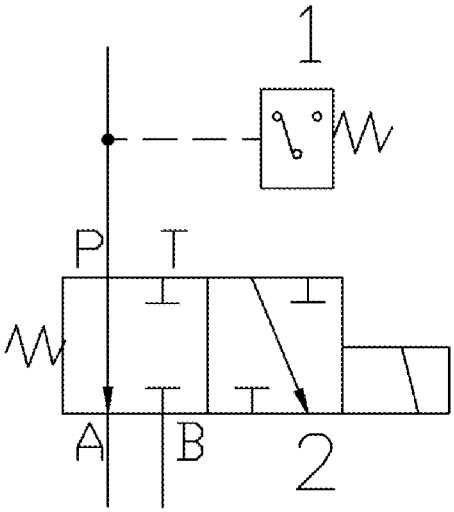
FIG. 2 shows a schematic view of a switching control module of the embodiment.
Figure 3:
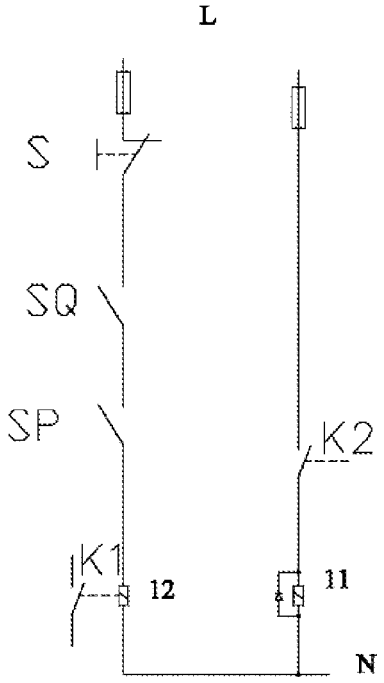
FIG. 3 shows a control schematic view for signaling by an electric in the embodiment.

FIG. 1 to FIG. 3: 1—pressure switch, 2—directional valve, 3—operating handle, 4—multi-way valve, 5—tank, 6—check valve, 7—oil pump, 8—load sensing priority valve, 9—hoisting cylinder, 10—filter, 11—coil of directional valve, 12—coil of relay, pin of K1 for connecting the intelligent display driving module, 13—pump inlet, 14—pressure charging port, 15—pump outlet.

Figure 4:
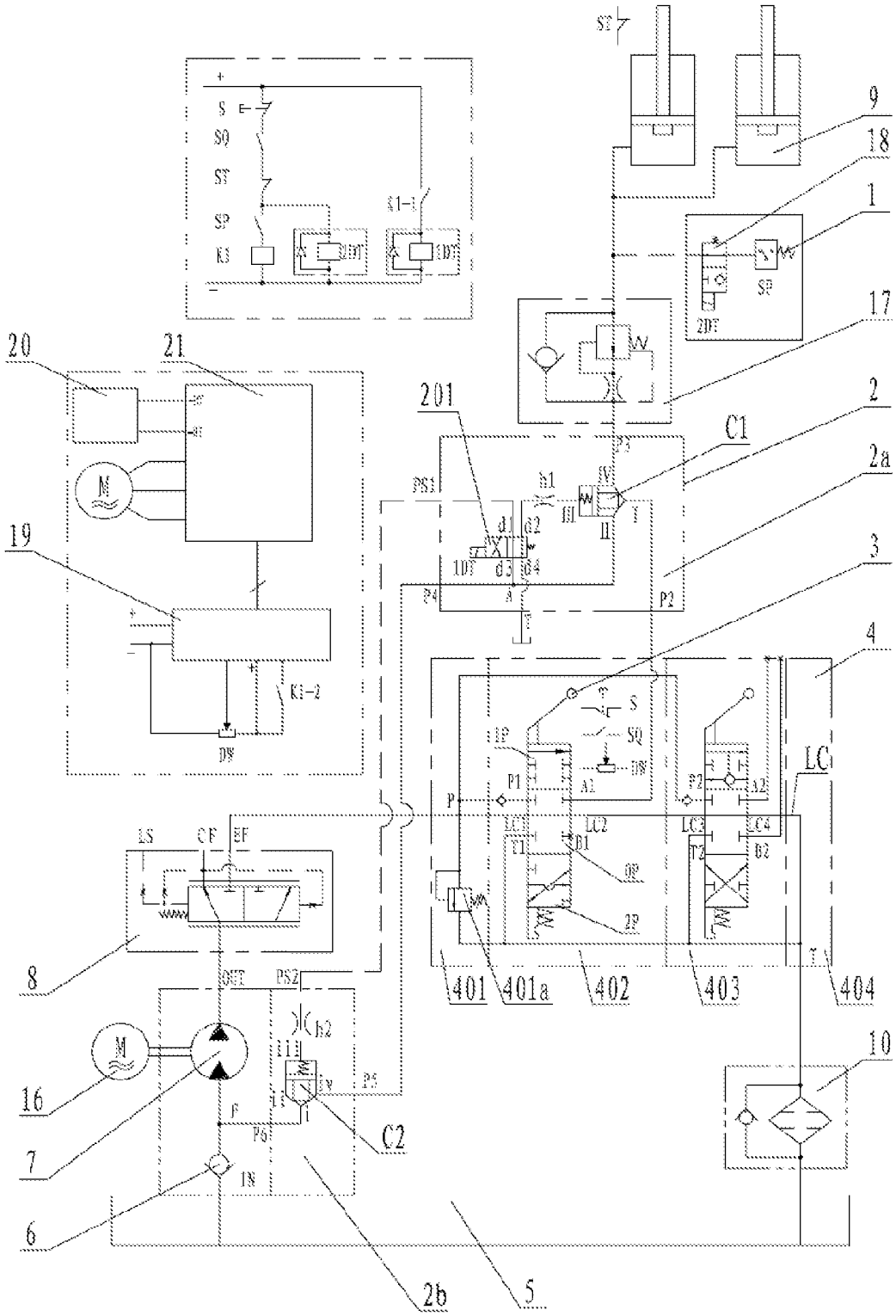
FIG. 4 shows a principle view of an embodiment 1.
Figure 5:
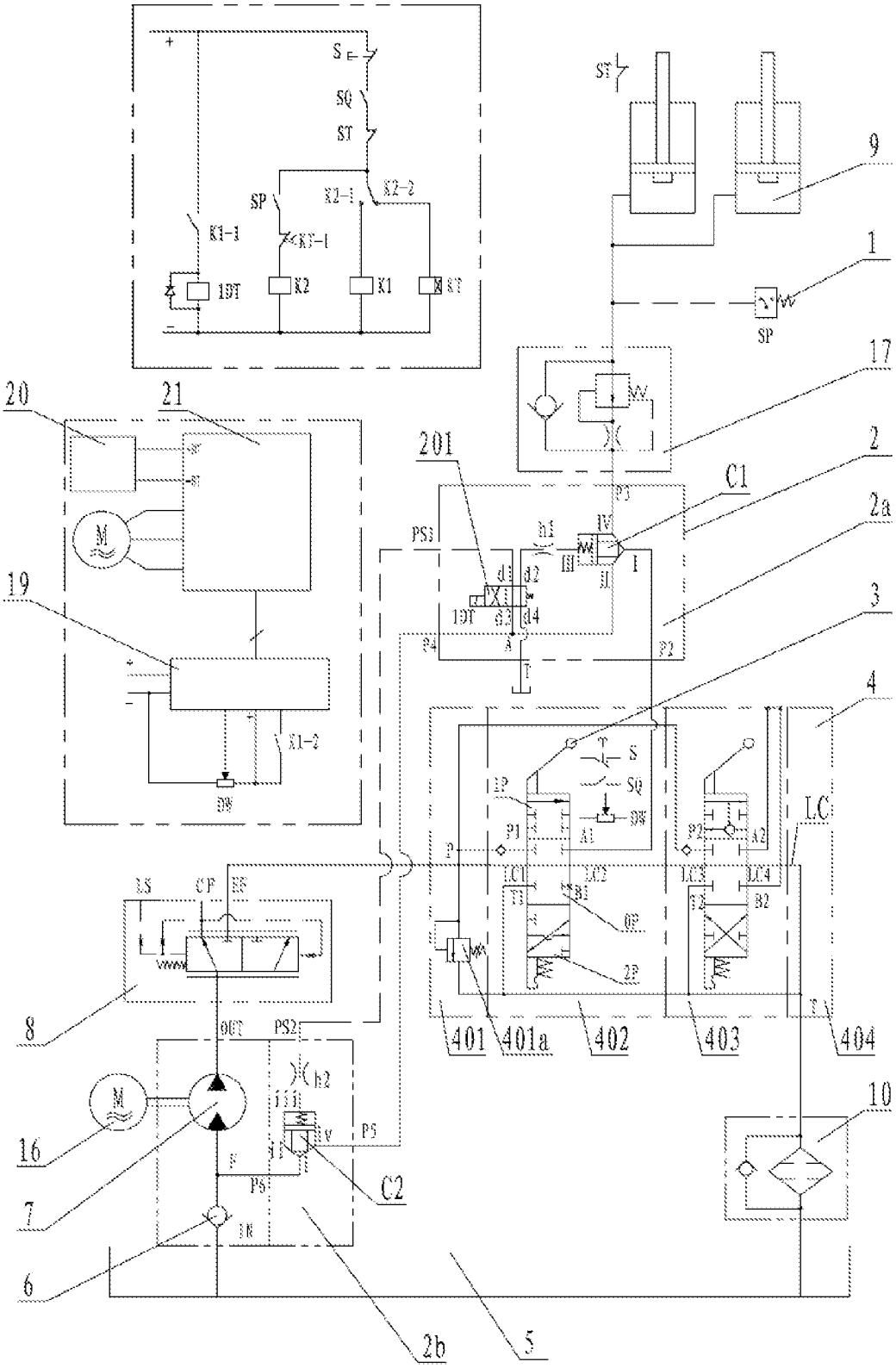
FIG. 5 shows a principle view of an embodiment 2.
Figure 6:
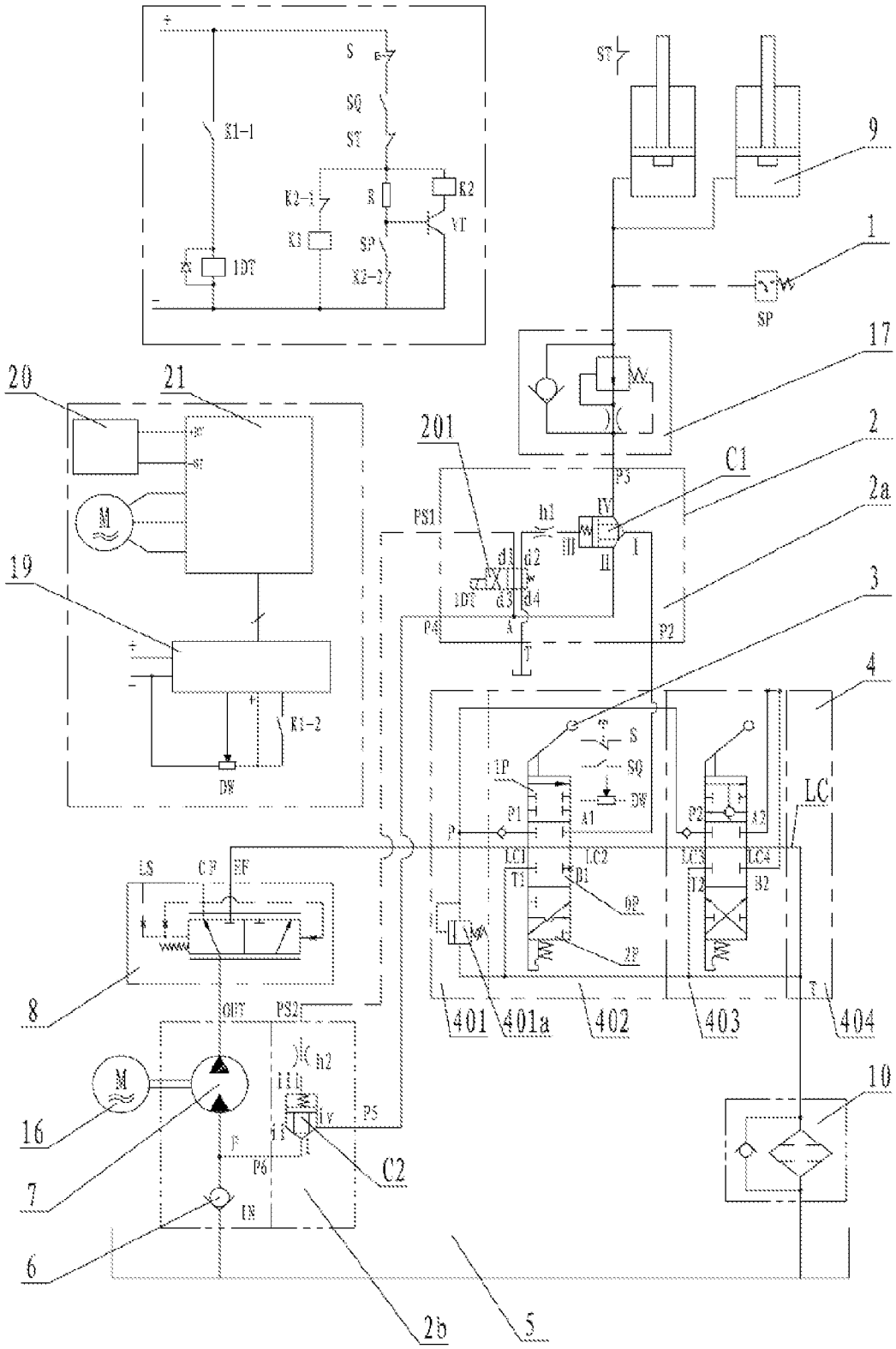
FIG. 6 shows a principle view of an embodiment 3.

FIG. 4 to FIG. 6: 1—pressure switch SP, 2—directional valve (2*a*: first unit body, 201: electromagnetic directional valve, 2*b*: second unit body), 3—operating handle, 4—multi-way valve (401: oil filling piece, 401*a*: relief valve, 402: hoisting piece, 403: tilting piece, 404: oil returning piece), 5—tank, 6—check valve, 7—oil pump, 8—load sensing priority valve, 9—hoisting cylinder, 10—filter, 16—electric motor, 17—governor valve, 18—pressure switch latching valve, 19—intelligent display, 20—electrical storage device, 21—converter (with a controller).

DETAILED DESCRIPTION OF THE INVENTION

The disclosure is further described below with reference to the drawings and embodiments in details.

Referring to FIG. 1 to FIG. 3, a switching control block with a pressure switch SP and an electromagnetic directional valve is additionally provided between a multi-way valve and a hoisting cylinder, as shown in FIG. 2; the function of the pressure switch SP is that: as the cargo will consume part of the electric energy when generating, only the cargo, of which the generating capacity is greater than the consumed electric energy for generating power, is the one which could be used for generating power, the SP is set by a demarcation point which is the lightest weight of the available cargo; the function of the directional valve is that: an electromagnet 1DT of the directional valve is not powered on when the cargo is in the hoisting operation, the pressure oil from a hoisting piece of the multi-way valve enters the hoisting cylinder via an A port and a P port of the directional valve to carry out the hoisting operation; when the cargo is in the lowering operation, whether the electromagnet of the directional valve is powered on could be carried out according to the instructions, when not powered on, the pressure oil in the hoisting cylinder enters the multi-way valve via a governor valve, and the P port and the A port of the directional valve, at the moment, similar to the operation which has no generation device, when the electromagnet of the directional valve is powered on, and the pressure switch controls whether the electromagnet of the directional valve will be powered on, the pressure oil in the hoisting cylinder enters the pump filling port F via the governor valve, the P port and a B port of the directional valve to generate power;

a signaling switch SQ for detecting the lowering of the cargo is additionally provided at the operating handle or the valve rod of the control valve hoisting unit, as shown in FIG. 4, the function thereof is to identify whether the operation is the lowering operation of the hoisting piece, if yes, powering on the switch so as to prepare for generation;

a button S is additionally provided at an operating handle of the hoisting unit, as shown in FIG. 4, the function thereof is that: if the operator does not want the system to enter a generation state in the lowering operation, the operator can press the button S to operate, at the moment, which is similar to the operation having no generation device;

the energy collection process: when the electric forkhoist truck forks the cargo and prepares to unload from the height, 1 the operator does not press the hoisting piece handle button S of the multi-way valve when pushing the handle forwards, at the moment, the handle will trigger and switch on the lowering detection switch SQ at the hoisting piece. If the pressure corresponding to the cargo is greater than or equal to the pressure set by the pressure switch SP, the pressure switch SP is switched on, and the current flows into a coil of a relay via the two switches which are connected in series, the coil is powered on to make two pairs of normal open switches K1 and K2 of the relay closed. The K1 is closed so as to make the pin of an intelligent display or a driving module receive an electric signal, the intelligent display or the driving module program detects the signal of the pin and outputs the alternating current with set frequency corresponding to the pin, thus starting the electric motor of the pump and driving the gear pump to rotate. The K2 is closed so as to make the electromagnet 1DT of the directional valve of the control block powered on, the electromagnetic valve is reversed to enter the right position, the P port and B port of the directional valve are communicated; the pressure oil in the hoisting cylinder is filled into a pump via the governor valve, the P port and B port of the directional valve, and an F port of the pump. At the moment, a check valve cuts off the pump to an inlet of a tank, the filled flow of the pressure oil is sufficient to make the pump operate with a rotating speed which exceeds that of the electric motor. Now, the pump actually works in a motor state and drives the electric motor to rotate, and the electric motor works in the generation state. The current generated by the electric motor is converted by the driving module and charged into the battery, thus achieving the purpose of collecting the potential energy of the cargo. During the generation process, other operations could be carried out. If no other operations are carried out, the oil of the pump outlet enters the tank via a load sensing priority valve EF, and the unloading oil duct, without flow-saving function in median position, of the multi-way valve. At this time, the consumption quantity of power is minimum, and the generation quantity is maximum. If the pressure corresponding to the cargo is smaller than the pressure value set by the pressure switch SP, the pressure switch SP is not switched on, the coil of the relay will not be powered on, the normal open switches K1 and K2 of the relay will not be closed. the pin of the intelligent display or the driving module does not receive the signal, the electric motor of the pump will not be started, the electromagnet 1DT of the directional valve will not be powered on, the directional valve will not be reversed. At the moment, the operation, similar to the operation which has no generation device, could be carried out to lower cargo. 2 when the operator presses the hoisting piece handle button S of the multi-way valve and pushes the handle forwards, the operation, similar to the operation which has no generation device at the moment, could be carried out to lower the cargo, and this function is mainly used for the conditions which require the micro-action lowering operations.

A switch K3 used as a fork swaying enabling switch is additionally provided at a walking accelerator, namely, the K3 is closed when operating the fork sideways, a frequency conversion driving module starts the electric motor with a steering frequency to drive the pump to operate, thus implementing the sideways operation. While the pin originally connected to the sideways moving switch K1 is used as a generation pin, the lowering speed of the cargo during generation in the process of lowering could be controlled by setting the frequency corresponding to the pin.

The directional valve 2 includes: a first reversing unit body 2*a* composed of a first cartridge valve C1, an electromagnetic directional valve 201, and a first damping orifice h1 connected with the first cartridge valve C1 and the electromagnetic directional valve 201; a second reversing unit orifice 2*b* composed of a second cartridge valve C2, the electromagnetic directional valve 201, and a second damping orifice h2 connected with the second cartridge valve C2 and a second control oil port PS2. A II port and a IV port of the first cartridge valve C1 are normally communicated. A I port is always capable of being communicated with the II port and the IV port, but the connection or disconnection from the II port and the IV port to the I port is under the control of the electromagnetic directional valve 201. A ii port and a iv port of the second cartridge valve C2 are normally communicated, the i port is always capable of being communicated with the ii port and the iv port, but the connection or disconnection from the ii port and the iv port to the i port is under the control of the electromagnetic directional valve 201. The electromagnetic directional valve 201 includes a first port d1, a second port d2, a third port d3 and a fourth port d4. When the electromagnetic directional valve 201 is not powered on, the first port d1 is communicated with the third port d3, the second port d2 is communicated with the fourth port d4, and now, the IV port of the first cartridge valve C1 could be connected to the I port thereof, the iv port of the second cartridge valve C2 could not be communicated with the i port thereof. When the electromagnetic directional valve 201 is powered on, the first port d1 is communicated with the fourth port d4, the second port d2 is communicated with the third port d3, and now the IV port of the first cartridge valve C1 could not be communicated with the I port thereof, the iv port of the second cartridge valve C2 could be communicated with the i port thereof, the power on or off of the electromagnetic directional valve 201 respectively controls a control port of the first cartridge valve C1 or the second cartridge valve C2 to be in a communicated state.

A first oil inlet P3 connected with the IV port of the first cartridge valve C1 is communicated with a working chamber of the hoisting cylinder 9 via the governor valve 17;

a first oil outlet P2 connected with the I port of the first cartridge valve C1 is communicated with an A1 port of the multi-way valve 4;

a second oil outlet P4 connected with the II port of the first cartridge valve C1 is communicated with a second oil inlet P5 of the second reversing unit body 2*b;* a first control oil port PS1 connected with the first port d1 of the electromagnetic directional valve 201 is communicated with the second control oil port PS2 of the second reversing unit body 2*b;* the first damping orifice h1 connected with a III port of the first cartridge valve C1 is communicated with the second port d2 of the electromagnetic directional valve 201;

the second oil inlet P5 connected with the iv port of the second cartridge valve C2 is communicated with the second oil outlet P4;

a third oil outlet P6 connected with the i port of the second cartridge valve C2 is communicated with an oil inlet of the pump/motor 7;

the second control oil port PS2 connected with the iii port of the second cartridge valve C2 is communicated with the first control oil port PS1;

the second damping orifice h2 connected with the iii port of the second cartridge valve C2 is communicated with the second control oil port PS2;

the first port d1 of the electromagnetic directional valve 201 is connected with the first control oil port PS1;

the second port d2 of the electromagnetic directional valve 201 is connected with the first damping orifice h1;

the junction among the third port d3 of the electromagnetic directional valve 201, the first oil inlet P3 and the second oil outlet P4 is a first node A;

the fourth port d4 of the electromagnetic directional valve 201 is connected with the tank.

The energy-recovery generation system for the handling and carrying electric vehicle, wherein the multi-way valve 4 includes:

an oil inlet piece 401, including:

a general oil inlet P, not only communicated with the hoisting piece P1 and an auxiliary port LC1, but also connected with an oil outlet OUT of the pump/motor 7; and a relief valve 401*a* for controlling the maximum pressure of the general oil inlet;

a hoisting piece 402, including:

an oil inlet P1 communicated with the general oil inlet P;

a working port A1 connected with the first oil outlet P2 of the first reversing unit body 2*a;* an oil returning port T1 communicated with the general oil returning port T; and the auxiliary ports LC1 and LC2, wherein the auxiliary port LC2 is communicated with an auxiliary port LC3;

a tilting piece 403, including:

an oil inlet P2 communicated with the general oil inlet P;

the working ports A2 and B2;

an oil returning port T2 communicated with the general oil returning port T; and the auxiliary ports LC3 and LC4, wherein the auxiliary port LC4 is communicated with the general oil returning port T;

an oil returning piece 404, including:

the general oil returning port T connected with the tank 5;

Wherein, when a valve spool of the hoisting piece is located at a median position 0P, the auxiliary ports LC1 and LC2 are communicated with each other, and then are communicated to the general oil returning port T; when the valve spool of the hoisting piece is located at a cargo hoisting position 1P, the oil inlet P1 is communicated with the working port A1, the auxiliary ports LC1 and LC2 are not communicated; when the valve spool of the hoisting piece is located at a cargo lowering position 2P, the working port A1 is communicated with the oil returning port T1, and the auxiliary ports LC1 and LC2 are communicated.

The energy-recovery generation system for the handling and carrying electric vehicle further includes a first control mode constituted by the pressure switch latching valve 18, and a first branch constituted by connecting the hoisting piece handle button S, the enabling signaling switch SQ and the hoisting cylinder full-extension detection switch ST in series; a first sub-branch, constituted by the pressure switch SP and the relay K1 which are connected in series, and a second sub-branch, constituted by a coil of an electromagnet 2DT of the pressure switch latching valve 18, are connected in parallel at one end of the first branch, where the hoisting cylinder full-extension detection switch ST is located, to form a first control branch; the first normal open switch K1-1 and the coil of the electromagnet 1DT of the electromagnetic directional valve 201 of the directional valve 2 are connected in series to form a second control branch; a second normal open switch K1-2 provides a lowering enabling signal; the speed control signal potentiometer DW provides a lowering speed control signal; the lowering enabling signal and the speed control signal are accessed to the intelligent display 19 or a controller of a converter 21.

The energy-recovery generation system for the handling and carrying electric vehicle further includes a second control mode constituted by a time relay KT and an intermediate relay K2. The time relay KT includes a first normal close switch KT-1, the intermediate relay K2 includes a third normal open switch K2-1 and a second normal close switch K2-2. The hoisting piece handle button S, the enabling signaling switch SQ and the hoisting cylinder full-extension detection switch ST are connected in series to form the first branch; a I sub-branch constituted by the pressure switch SP, the first normal close switch KT-1 and a coil of the intermediate relay K2 which are connected in series is connected in parallel at one end of the first branch, where the hoisting cylinder full-extension detection switch ST is located; a second normal open switch K2-1 and the coil of the relay K1 are connected in series to form a II sub-branch; the second normal close switch K2-2 and the coil of the time relay KT are connected in series to form a III sub-branch, thus forming a third control branch. The first normal open switch K1-1 and the coil of the electromagnet 1DT of the electromagnetic directional valve 201 of the directional valve 2 are connected in series to form a second control branch. The second normal open switch K1-2 provides a lowering enabling signal; the speed control signal potentiometer DW provides a lowering speed control signal; the lowering enabling signal and the speed control signal are accessed to the intelligent display 19 or a controller of a converter 21.

The energy-recovery generation system for the handling and carrying electric vehicle further includes a third control mode constituted by an intermediate relay K2, a resistor R and a transistor VT. The intermediate relay includes a first normal close switch K2-1 and a second normal close switch K2-2. The hoisting piece handle button S, the enabling signaling switch SQ and the hoisting cylinder full-extension detection switch ST are connected in series to form a first branch; a i sub-branch constituted by the normal close switch K2-1 and the coil of the relay K1 which are connected in series, a ii sub-branch constituted by the resistor R, the pressure switch SP and the second normal close switch K2-2 which are connected sin series, and a iii sub-branch constituted by the coil of the intermediate relay K2, and a collector and an emitter of the transistor VT which are connected in series are connected in parallel at one end of the first branch, where the hoisting cylinder full-extension detection switch ST is located, a base of the transistor VT is connected between the resistor R of the second sub-branch and the pressure switch SP, to form a fourth control branch; the first normal open switch K1-1 and the coil of the electromagnet 1DT of the electromagnetic directional valve 201 of the directional valve 2 are connected in series to form the second control branch; the second normal open switch K1-2 provides a lowering enabling signal; the speed control signal potentiometer DW provides a lowering speed control signal; the lowering enabling signal and the speed control signal are accessed to the intelligent display 19 or a controller of a converter 21.

The energy-recovery generation system for the handling and carrying electric vehicle, wherein the energy storage device is a battery, a capacitor or a lithium battery.

The energy-recovery generation system for the handling and carrying electric vehicle, wherein a check valve is provided at the pipeline between the motor or pump inlet and the tank.

Embodiment 1

As shown in FIG. 4, the oil pump 7 adopts the hydraulic gear pump with motor function, a check valve 6 is additionally provided at the oil suction port; the check valve 6 has two functions:

first, the gear pump can absorb oil from the tank via the check valve 6 when being used as a pump;

second, when the gear pump is used as a motor, the check valve 6 can cut off the pressure oil from the second unit body 2*b* of the directional valve 2 not to enter the tank, thus preventing the high-pressure oil directly back-flowing to the tank without passing through the oil pump 7.

A pressure switch 1SP is additionally provided between the governor valve 17 and the hoisting cylinder 9, a first unit body 2*a* of the directional valve 2 is additionally provided between the multi-way valve 4 and the governor valve 17, a second unit body 2*b* of the directional valve 2 is additionally provided at the inlet of the motor or pump 7;

the function of the pressure switch 1SP is that:

as the cargo will consume part of the electric energy when generating, only the cargo, of which the generating capacity is greater than the consumed electric energy for generating power, is the one which could be used for generating power, the SP is set by a demarcation point which is the lightest weight of the available cargo;

the function of the directional valve 2 is that:

first, when the cargo is in the hoisting operation, the electromagnet 1DT of the electromagnetic directional valve 201 of the first unit body 2*a* of the directional valve 2 are not powered on, the pressure oil from the hoisting piece of the multi-way valve 4 enters the hoisting cylinder 9 via the first unit body 2*a* to carry out the hoisting operation, the second unit body 2*b* cuts off the hoisting pressure oil not to enter the inlet of the motor or the oil pump 7;

second, when the cargo is in the lowering operation, whether the electromagnet 1DT of the electromagnetic directional valve 201 of the first unit body 2*a* of the directional valve 2 are powered on will be carried out according to the instructions. When not powered on, the second unit body 2*b* cuts off the pressure oil not to enter the inlet of the motor or the oil pump 7, the pressure oil in the hoisting cylinder 9 could enter the multi-way valve 4 only via the governor valve 17, and the first unit body 2*a* of the directional valve 2, at the moment, the operation is similar to the operation which has no generation device. When whether the electromagnet 1DT is powered on is controlled by the pressure switch 1, the pressure oil in the hoisting cylinder 9 flows into the oil suction port of the motor or the oil pump 7 via the governor valve 17, the first unit body 2*a* of the second directional valve 2, and the second unit body 2*b* of the second directional valve 2 to generate power;

wherein the function of the two damping orifices h1 and h2 is mainly to control the opening and closing speed of the first cartridge valve C1 and the second cartridge valve C2 of the directional valve 2, thus reducing the impaction when reversing.

The function of the pressure switch latching valve 18 is that:

when the cargo, of which the weight pressure is close to the set valve of the pressure switch 1SP, begins to lower, the pressure fluctuation in the pipeline between the hoisting cylinder 9 and the governor valve 17 is always aroused due to excessive speed of the operating handle 3, so that the directional valve 2 keeps reversing because the pressure switch 1SP is intermittently powered on and off, thus finally causing the vibration in the lowering process of the cargo. In order to prevent such situation, the latching valve 18 is set at the inlet of the pressure switch 1SP; the latching valve can lock the pressure of the pressure switch 1SP when the cargo is lowering, thus preventing the cargo from the influences of the pressure fluctuation.

The function of the full-extension detection switch ST of the hoisting cylinder 9 is that: when the hoisting cylinder 9 fully extends in place, the pressure of the hoisting cylinder reaches the pressure set by the relief valve 401*a* of the multi-way valve 4. If lowering without load at the moment, the signal collected by the pressure switch is an overflow pressure signal, and the signal meets the generation condition, the electric motor 16 will be started to generate power; however, no energy is recovered under non-load situation, while the power will be consumed in fact; In order to prevent such situation, it needs to set the full-extension detection switch ST of the hoisting cylinder 9.

The lowering enabling switch SQ for detecting the cargo is additionally provided at the operating handle 3 or the valve rod of the hoisting piece of the control valve, the function thereof is to identify whether the operation is the lowering operation of the hoisting piece, if yes, powering on the switch to prepare for generation;

the button S is additionally provided at the operating handle 3 of the hoisting piece of the control valve, the function thereof is that: if the operator does not want the system to enter the generation state in the lowering operation, the operator can press the button S to operate, and now, the operation is similar to the operation which has no generation device.

The energy collection process: when the electric forkhoist truck forks the cargo and prepares to unload from the height, the operate can choose based on the requirements: 1 when the operator pushes the operating handle of the hoisting piece of the multi-way valve 4 forwards without pressing the button S, the operating handle 3 will trigger and power on the lowering enabling detection switch SQ provided at the hoisting piece. If the pressure corresponding to the cargo is smaller than the set value of the pressure switch 1, the pressure switch 1SP is not switched on, the coil of K1 are not powered on, the normal open switches K1-1 and K1-2 of the relay K1 are not closed, the pin of the intelligent display 19 or the controller of the converter 21 does not receive the signal, and the electric motor 16 of the pump is not started, the electromagnet 1DT of the electromagnetic valve 201 of the first unit body 2*a* of the directional valve 2 is not powered on, at the moment, the P3 port and P2 port of the first unit body 2*a* of the directional valve 2 are communicated, however the second unit body 2*b* of the directional valve 2 and the oil suction port of the motor or oil pump 7 are disconnected, and now the lowering operations, similar to the original operation which has no generation device, could be operated to lower the cargo. If the pressure corresponding to the cargo is greater than or equal to the set value of the pressure switch 1SP, the pressure switch 1SP is powered on, the current flows into the coil of relay K1 via the two switches which are connected in series, the coil are powered on as so to make the two pairs of the normal open switches K1-1 and K1-2 of the relay closed. The K1-2 is closed to make the pin of the intelligent display 19 or the controller of the converter 21 receives the electric signal, the driving program detects the signal of the pin and outputs the alternating current with the corresponding frequency, thus starting the electric motor 16 of the pump so as to drive the motor or the oil pump 7 to rotate. The K1-1 is closed to make the electromagnet 1DT of the electromagnetic directional valve 201 of the first unit body 2*a* of the directional valve 2 powered on, the electromagnetic valve is reversed to the left position, the P3 port and P2 port of the first unit body 2*a* of the directional valve 2 are cut off, the P5 port and P6 port of the second unit body 2*b* of the directional valve 2 are communicated, the pressure oil in the hoisting cylinder 9 flows into the inlet of the motor or the oil pump 7 via the governor valve 17, the P3 and P4 ports in the first unit body 2*a* of the directional valve 2, and the second unit body 2*b* of the directional valve 2; the check valve 6 at the inlet of the motor or oil pump 7 cuts off the oil duct between the inlet of the motor or oil pump 7 and the outlet of the tank 5. The flow of the pressure oil filled is sufficient to make the motor or oil pump 7 have the trend of operating with a speed which exceeds the synchronous rotating speed of the electric motor 16. At the moment, the motor or oil pump 7 actually works in a motor state and drives the rotator of the electric motor 16 to rotate; the electric motor 16 works in a generation state, the current generated by the electric motor 16 is converted by the converter 21 and charged into the electrical storage device 20, thus achieving the purpose of collecting the potential energy of the cargo. In order control the lowering speed of the cargo when generating power, the potentiometer DW which is under the control of the forward pushing stroke of the handle is further provided at the operating handle 3. The signal output by the potentiometer DW controls the synchronous rotating speed of the electric motor 16. When the forward pushing stroke of the operating handle 3 is small, the signal output by the potentiometer DW makes the electric motor 16 have a low synchronous rotating speed. When the forward pushing stroke of the operating handle 3 is large, the signal output by the potentiometer DW makes the electric motor 16 have a high synchronous rotating speed. However the maximum rotating speed of the motor or oil pump 7 is controlled by the synchronous rotating speed of the electric motor 16 when lowering to generate power, thus the lowering speed of the cargo is finally controlled by the operating handle 3. As the rotating direction of the electric motor 16 is not changed when lowering to generate power, the original operation will not be affected at all. If no other operations are carried out during the lowering generation process, the oil from the oil outlet of the motor or oil pump 7 enters the tank 5 via the load sensing directional valve 8EF and the unloading oil duct without the flow-saving function in the median position of the multi-way valve 4. At this time, the power consumption quantity is minimum, and the generation quantity is maximum. 2. when the operator presses the button S and pushes the operating handle 3 forwards, the operation, similar to the operation which has no generation device, could be carried out to lower the cargo, and this button is mainly used for canceling the lowering generation function.

Embodiments 2 and 3

Respectively referring to FIG. 5 and FIG. 6, the difference from the FIG. 4 is that: no pressure switch latching valve is provided at the hydraulic loop of the FIG. 5 and FIG. 6. However, in order to provide the function similar to the pressure switch latching valve, the FIG. 5 and FIG. 6 realize the following electrical principle: when the cargo, of which the weight pressure is close to the set value of the pressure switch 1, begins to lower, the pressure fluctuation in the pipeline between the hoisting cylinder 9 and the governor valve 17 is aroused due to the excessive speed of the operating handle, so that the directional valve 2 keeps reversing because the pressure switch 1SP is intermittently powered on and off, which causes the vibration in the lowering process of the cargo. In order to prevent such situation, the electrical principle of the FIG. 2 and FIG. 3 only locks the switch off of the pressure switch 1SP. If the pressure switch 1SP is switched off at the moment that the cargo begins to lower or in the subsequent process, the electrical control will quickly cut off the electrical branch where the pressure switch 1SP is located, and will not detect the state of the pressure switch 1SP anymore; the relay K1 will not be powered on, the potential energy of the cargo will not be recovered, thus removing the above adverse factors. With respect to other control processes, the FIG. 5 and FIG. 6 are similar to the FIG. 4, and are not repeated.

The above is only the preferred embodiment of the disclosure; for those skilled in the field, the disclosure can have various changes and modifications. Any modifications, equivalent replacement and improvement carried out within the spirits and principle of the disclosure shall fall within the protection scope of the disclosure.

What is claimed is:

1. An energy-recovery generation system for a handling and carrying electric vehicle, comprising:

a hoisting cylinder having an output pipeline provided with a pressure sensor unit and a directional valve;

the directional valve is under the control of the pressure sensor unit;

a first outlet of the directional valve is connected to a tank via a multi-way valve with an operating handle;

pressure oil is configured to flow out from a second outlet of the directional valve, pass through a pump having an oil suction port capable of bearing pressure or through a motor, and then pass through the multi-way valve, to finally flow back to the tank;

the pump or the motor drives an electric motor to output electric energy; and an electric energy output end of the electric motor is connected to an energy storage device through a converter, the energy-recovery generation system further comprising a lifting piece handle button, a cargo lowering detection enabling signaling switch, a speed control signal potentiometer and a relay, wherein the pressure sensor unit comprises a pressure switch and a hoisting cylinder full-extension detection switch; the relay comprises a first normal open switch and a second normal open switch; the hoisting piece handle button, the cargo lowering detection enabling signaling switch, the pressure switch and a coil of the relay are connected in series to form a first control branch; the second normal open switch of the relay and a coil of an electromagnet for controlling the directional valve are connected in series to form a second control branch.

2. The energy-recovery generation system according to claim 1, wherein the multi-way valve with the operating handle is a mechanically-operated multi-way valve, an electrically-controlled multi-way valve or a hydraulically-controlled multi-way valve.

3. The energy-recovery generation system according to claim 1, wherein the pressure sensor unit is a pressure switch or a pressure sensor.

4. The energy-recovery generation system according to claim 1, wherein a pipeline between an inlet of the pump or the motor and the tank is provided with a check valve.

5. The energy-recovery generation system according to claim 1, wherein:

the directional valve comprises a first reversing unit body and a second reversing unit body;

an oil supply path is formed among an oil outlet of the or the motor, the multi-way valve, the directional valve and a working chamber of the hoisting cylinder;

a first oil discharge path is formed among the working chamber of the hoisting cylinder, the first reversing unit body of the directional valve, the multi-way valve and the tank;

a second oil discharge path is formed among the working chamber of the hoisting cylinder, the first reversing unit body and the second reversing unit body of the directional valve, and the oil inlet of the pump or the motor; and the first oil discharge path and the second oil discharge path are selectively communicated by the directional valve when the hoisting cylinder drains oil.

6. The energy-recovery generation system according to claim 5, wherein:

the first reversing unit body comprises a first cartridge valve, an electromagnetic directional valve, and a first damping orifice connected to the first cartridge valve and the electromagnetic directional valve;

the second reversing unit body comprises a second cartridge valve, an electromagnetic directional valve, and a second damping orifice connected to the second cartridge valve and to a second control oil port;

a II port and a IV port of the first cartridge valve are normally communicated;

a I port of the first cartridge valve is always capable of being communicated with the II port and the IV port, and the connection or disconnection from the II port and the IV port to the I port is under the control of the electromagnetic directional valve;

a i port and a iv port of the second cartridge valve are normally communicated, the i port is always capable of being communicated with the ii port and the iv port, and the connection or disconnection from the ii port and the iv port to the i port is under the control of the electromagnetic directional valve, and the power on or off of the electromagnetic directional valve respectively controls a control port of the first cartridge valve or that of the second cartridge valve to be in a communicated state.

7. The energy-recovery generation system according to claim 1, further comprising:

a first control mode constituted by a pressure switch latching valve, wherein a first branch is constituted by connecting the hoisting piece handle button, the enabling signaling switch and the hoisting cylinder full-extension detection switch in series;

a first sub-branch constituted by connecting the pressure switch and the relay in series and a second sub-branch constituted by a coil of an electromagnet of the pressure switch latching valve are connected in parallel at one end of the first branch, where the hoisting cylinder full-extension detection switch is located, to form the first control branch;

the first normal open switch and a coil of an electromagnet of the electromagnetic directional valve of the directional valve are connected in series to form the second control branch;

the second normal open switch provides a lowering enabling signal;

the speed control signal potentiometer provides a lowering speed control signal; and the lowering enabling signal and the speed control signal are accessed to an intelligent display or a controller of the converter.

8. The energy-recovery generation system according to claim 1, further comprising:

a second control mode constituted by a time relay and an intermediate relay, wherein the time relay comprises a first normal close switch, the intermediate relay comprises a third normal open switch and a second normal close switch;

the hoisting piece handle button, the enabling signaling switch and the hoisting cylinder full-extension detection switch are connected in series to form a first branch;

a I sub-branch constituted by connecting the pressure switch, the first normal close switch and a coil of the intermediate relay in series, a II sub-branch constituted by connecting the third normal open switch and the coil of the relay, and a III sub-branch constituted by connecting the second normal close switch and a coil of the time relay in series are connected in parallel at one end of the first branch, where the hoisting cylinder full-extension detection switch is located, to form a third control branch;

the first normal open switch and a coil of an electromagnet of the electromagnetic directional valve of the directional valve are connected in series to form the second control branch;

the second normal open switch provides a lowering enabling signal;

the speed control signal potentiometer provides a lowering speed control signal; and the lowering enabling signal and the speed control signal are accessed to an intelligent display or a controller of the converter.

9. The energy-recovery generation system according to claim 1, further comprising:

a third control mode constituted by an intermediate relay, a resistor and a transistor, wherein the intermediate relay comprises a first normal close switch and a second normal close switch;

the hoisting piece handle button, the enabling signaling switch and the hoisting cylinder full-extension detection switch are connected in series to form a first branch;

a i sub-branch constituted by connecting the normal close switch and the coil of the relay in series, a ii sub-branch constituted by connecting the resistor, the pressure switch and the second normal close switch in series, and a iii sub-branch constituted by connecting a coil of an intermediate relay, a collector and an emitter of the transistor in series are connected in parallel at one end of the first branch where the hoisting cylinder full-extension detection switch is located;

a base of the transistor is connected between the resistor of the ii sub-branch and the pressure switch to form a fourth control branch;

the first normal open switch and a coil of an electromagnet of the electromagnetic directional valve of the directional valve are connected in series to form the second control branch; the second normal open switch provides a lowering enabling signal;

the speed control signal potentiometer provides a lowering speed control signal; and the lowering enabling signal and the speed control signal are accessed to an intelligent display or a controller of the converter.

10. The energy-recovery generation system according to claim 2, wherein a pipeline between an inlet of the pump or the motor and the tank is provided with a check valve.

11. The energy-recovery generation system according to claim 3, wherein a pipeline between an inlet of the pump or the motor and the tank is provided with a check valve.

12. The energy-recovery generation system according to claim 3, further comprising:

a first control mode constituted by a pressure switch latching valve, wherein a first branch are constituted by connecting the hoisting piece handle button, the enabling signaling switch and the hoisting cylinder full-extension detection switch in series;

a first sub-branch constituted by connecting the pressure switch and the relay in series and a second sub-branch constituted by a coil of an electromagnet of the pressure switch latching valve are connected in parallel at one end of the first branch, where the hoisting cylinder full-extension detection switch is located, to form the first control branch; the first normal open switch and a coil of an electromagnet of the electromagnetic directional valve of the directional valve are connected in series to form the second control branch;

the second normal open switch provides a lowering enabling signal;

the speed control signal potentiometer provides a lowering speed control signal; and the lowering enabling signal and the speed control signal are accessed to an intelligent display or a controller of the converter.

13. The energy-recovery generation system according to claim 3, further comprising:

a second control mode constituted by a time relay and an intermediate relay, wherein the time relay comprises a first normal close switch, the intermediate relay comprises a third normal open switch and a second normal close switch;

the hoisting piece handle button, the enabling signaling switch and the hoisting cylinder full-extension detection switch are connected in series to form a first branch; a I sub-branch constituted by connecting the pressure switch, the first normal close switch and a coil of the intermediate relay in series, a II sub-branch constituted by connecting the third normal open switch and the coil of the relay, and a III sub-branch constituted by connecting the second normal close switch and a coil of the time relay in series are connected in parallel at one end of the first branch, where the hoisting cylinder full-extension detection switch is located, to form a third control branch;

the first normal open switch and a coil of an electromagnet of the electromagnetic directional valve of the directional valve are connected in series to form the second control branch; the second normal open switch provides a lowering enabling signal;

the speed control signal potentiometer provides a lowering speed control signal; and the lowering enabling signal and the speed control signal are accessed to an intelligent display or a controller of the converter.

14. The energy-recovery generation system according to claim 3, further comprising:

a third control mode constituted by an intermediate relay, a resistor and a transistor, wherein the intermediate relay comprises a first normal close switch and a second normal close switch;

the hoisting piece handle button, the enabling signaling switch and the hoisting cylinder full-extension detection switch are connected in series to form a first branch;

a i sub-branch constituted by connecting the normal close switch and the coil of the relay in series, a ii sub-branch constituted by connecting the resistor, the pressure switch and the second normal close switch in series, and a iii sub-branch constituted by connecting a coil of an intermediate relay, a collector and an emitter of the transistor in series are connected in parallel at one end of the first branch where the hoisting cylinder full-extension detection switch is located;

a base of the transistor is connected between the resistor of the ii sub-branch and the pressure switch to form a fourth control branch;

the first normal open switch and a coil of an electromagnet of the electromagnetic directional valve of the directional valve are connected in series to form the second control branch; the second normal open switch provides a lowering enabling signal;

the speed control signal potentiometer provides a lowering speed control signal; and the lowering enabling signal and the speed control signal are accessed to an intelligent display or a controller of the converter.

* * * * *